US007975338B2

(12) United States Patent
Baek et al.

(10) Patent No.: US 7,975,338 B2
(45) Date of Patent: Jul. 12, 2011

(54) DRUM TYPE WASHING MACHINE AND DRYER AND METHOD FOR AUTOMATIC DRYING BY USING THE SAME

(75) Inventors: Seung Myun Baek, Changwon-si (KR); Sun Cheol Bae, Mansan-si (KR); Chang Woo Son, Busan (KR); Dae Woong Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/465,157

(22) Filed: May 13, 2009

(65) Prior Publication Data

US 2009/0223082 A1 Sep. 10, 2009

Related U.S. Application Data

(62) Division of application No. 11/137,804, filed on May 26, 2005, now abandoned.

(51) Int. Cl.
*A01H 5/02* (2006.01)

(52) U.S. Cl. ..... 8/148; 34/443; 34/524
(58) Field of Classification Search ..... None
See application file for complete search history.

(56) References Cited

U.S. PATENT DOCUMENTS 5,207,764 A 5/1993 Akabane et al.

FOREIGN PATENT DOCUMENTS

JP 06-182097 7/1994
JP 2004-222763 8/2004

*Primary Examiner* — Michael Kornakov
*Assistant Examiner* — Eric Golightly
(74) *Attorney, Agent, or Firm* — KED & Associates LLP

(57) ABSTRACT

An automatic drying method is provided for a drum type washing machine and dryer having an upper temperature sensors A1 and a lower temperature sensor A2 mounted at upper and lower portions of an inside of a duct that is an air circulating passage for drying laundry respectively, for performing a drying cycle by using a difference of temperatures sensed at the upper temperature sensor A1 and the lower temperature sensor A2, respectively.

5 Claims, 19 Drawing Sheets

FIG. 8

| A time period in which a temperature difference between A1 and A2 is greater than $T_2$ | Assumed laundry amount to be dried | Pressing drying | General drying | Strong drying |
|---|---|---|---|---|
| t1 | 1Kg | $t1+\beta 11$ | $t1+\beta 12$ | $t1+\beta 13$ |
| $t1+\alpha 1=t2$ | 2Kg | $t2+\beta 21$ | $t2+\beta 22$ | $t2+\beta 23$ |
| $t1+\alpha 1+\alpha 2=t3$ | 3Kg | $t3+\beta 31$ | $t3+\beta 32$ | $t3+\beta 33$ |
| $t1+\alpha 1+\alpha 2+\alpha 3=t4$ | 4Kg | $t4+\beta 41$ | $t4+\beta 42$ | $t4+\beta 43$ |
| $t1+\alpha 1+\alpha 2+\alpha 3+\alpha 4=t5$ | 5Kg | $t5+\beta 51$ | $t5+\beta 52$ | $t5+\beta 53$ |
| $t1+\alpha 1+\alpha 2+\alpha 3+\alpha 4+\alpha 5=t6$ | 6Kg | $t6+\beta 61$ | $t6+\beta 62$ | $t6+\beta 63$ |

FIG. 12

| A time period in which a temperature difference between $A2_{(max)}$ and A2 is greater than $T_2$ | Assumed laundry amount to be dried | Pressing drying | General drying | Strong drying |
|---|---|---|---|---|
| t1 | 1Kg | $t1+\beta 11$ | $t1+\beta 12$ | $t1+\beta 13$ |
| $t1+\alpha 1=t2$ | 2Kg | $t2+\beta 21$ | $t2+\beta 22$ | $t2+\beta 23$ |
| $t1+\alpha 1+\alpha 2=t3$ | 3Kg | $t3+\beta 31$ | $t3+\beta 32$ | $t3+\beta 33$ |
| $t1+\alpha 1+\alpha 2+\alpha 3=t4$ | 4Kg | $t4+\beta 41$ | $t4+\beta 42$ | $t4+\beta 43$ |
| $t1+\alpha 1+\alpha 2+\alpha 3+\alpha 4=t5$ | 5Kg | $t5+\beta 51$ | $t5+\beta 52$ | $t5+\beta 53$ |
| $t1+\alpha 1+\alpha 2+\alpha 3+\alpha 4+\alpha 5=t6$ | 6Kg | $t6+\beta 61$ | $t6+\beta 62$ | $t6+\beta 63$ |

DRUM TYPE WASHING MACHINE AND DRYER AND METHOD FOR AUTOMATIC DRYING BY USING THE SAME

CROSS-REFERENCE TO RELATED APPLICATIONS

This application is a Divisional Application of prior U.S. patent application Ser. No. 11/137,804, filed May 26, 2005, now abandoned the entire disclosure of which is hereby incorporated by reference.

BACKGROUND OF THE INVENTION

1. Field of the Invention

The present invention relates to drum type washing machines, and more particularly, to a drum type washing machine and dryer and a method for automatic drying by using the same, in which a temperature sensor is provided to a duct therein for determining a dryness by using a temperature change of an inside of the duct.

2. Discussion of the Related Art

In general, the drum type washing machine, performing washing by using friction between a drum rotated by driving force from a motor and laundry in a state detergent, washing water, and the laundry are introduced therein, gives less damage to the laundry, has less entangling of the laundry, and can provide a washing effect of pounding and rubbing the laundry.

Keeping pace with the trend of improving functions of, and manufacturing high quality drum type washing machines, it is a trend that demands on the drum type washing machine and dryer are also increasing, which enables, not only washing and spinning, but also drying of the laundry.

The drum type washing machine and dryer forcibly draws and heat external air by fan and heater mounted on an outside of a tub, and blows heated high temperature air toward an inside of the tub, to dry the laundry.

In general, a related art drum type washing machine performs drying by a manual drying method in which a user selects a desired drying course, and sets an appropriate drying time period according to an amount of the laundry, and makes a drying cycle performed, wherein, due to failure in performing an accurate drying cycle, to dry the laundry imperfectly, or excessively, a user desired drying state can not be met.

Referring to FIG. 1A, in order to solve such a problem, a device is developed, in which temperatures of an inside of the tub, and an inside of the duct are sensed by using a temperature sensor in the tub for sensing the inside of the tub, and a duct temperature sensor in the duct, estimates a laundry amount according to a temperature difference of the tub temperature and the duct temperature automatically, and sets a drying time period according to the laundry amount estimated thus, for performing the drying cycle.

For an example, referring to FIG. 1B, if a difference between the temperature ('a duct temperature') measured with the duct temperature sensor in the duct and the temperature ('a tub temperature') measured with the temperature sensor in the tub is greater than a certain value K in a first step, the laundry amount is determined to be ordinary (2~3 kg), if the difference of the duct temperature and the tub temperature is smaller than the certain value K in the first step, and the difference of temperatures is reduced from a maximum value by a certain level in a second step, the laundry amount is determined to be small (500 g~1 kg), and if the difference of temperatures is smaller than the certain value in the first, and second steps, to fail to determined the laundry amount, the laundry amount is determined to be great (3.5~4.5 kg) in which above steps are terminated after a certain time period, for performing the drying cycle.

However, above determination of laundry amount by using the difference of the tub temperature and the duct temperature has difficulty in sub-division of a range of the laundry amount required for determination of an accurate laundry amount, and, it is known from experience that above determination has no consistency throughout an entire range of laundry amount, making that it is difficult to perform the drying cycle according to above determination.

Particularly, when the laundry amount is small, the laundry suffers from damage caused by excessive drying.

Moreover, above related art drying cycle performing method has a difficulty in making accurate drying for entire range of laundry amount, and excessively large range of drying time period divisions, unable to apply to a large sized drum type washing machine greater than 10 Kg.

Moreover, because the related art automatic drying cycle performing method does not take a position of the temperature sensor in the tub. a deviation of the temperature sensor itself, a deviation of a structure of the duct, a deviation of a beating performance into account, test pieces show different temperature characteristics.

In such cases, it is not reasonable to apply one algorithm to all washing machines.

The deviation of every test piece leads application of an automatic drying algorithm for performing accurate drying the consumers desire difficult.

SUMMARY OF THE INVENTION

Accordingly, the present invention is directed to a drum type washing machine and dryer and a method for automatic drying by using the same that substantially obviates one or more problems due to limitations and disadvantages of the related art.

An object of the present invention is to provide a drum type washing machine and dryer which enables accurate and detailed dryness determination by using a temperature change at a condensing duct as drying progresses.

Another object of the present invention is to provide a drum type washing machine and dryer and a method for automatic drying by using the same, in which temperature sensors are provided to an upper portion and a lower portion of a condensing duct, for enabling accurate and detailed dryness determination by using a temperature change at a condensing duct.

Another object of the present invention is to provide a drum type washing machine and dryer and a method for automatic drying by using the same, in which a temperature sensor is provided to a condensing duct, for enabling accurate and detailed dryness determination by using a temperature change at the condensing duct.

A further object of the present invention is to provide a drum type washing machine and dryer and a method for automatic drying by using the same, in which a temperature deviation compensation function is provided for enabling an accurate drying of all test pieces by compensating for a temperature deviation occurred at the time of progressing an automatic drying algorithm with a temperature sensor.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drum type washing machine and dryer includes a tub having a tub rotatably mounted therein, a duct of an air circulating passage for drying laundry in the tub, upper and lower temperature sensors at upper, and lower portions of an inside of the duct, for sensing temperatures, respectively, wherein a difference between a temperature sensed at the upper temperature sensor and a temperature sensed at the lower temperature sensor is used, for determination of a laundry amount and dryness of the laundry.

Preferably, the lower temperature sensor is mounted at a position where a temperature sensed thereby vary with temperature change of mixture of cooling water and condensed water held at a lower end of the duct.

Preferably, the temperature sensed at the upper temperature sensor and a temperature sensed at the lower temperature sensor have temperature sense profiles, the same with each other at a drying cycle beginning step, and different from each other at a drying cycle end step due to a change of a ratio of mixture of the cooling water and the condensed water at the lower end of the duct.

The temperature sensed at the lower temperature sensor starts to drop, and the temperature sensed at the upper temperature sensor starts to rise at a time the amount of condensed water starts to reduce.

In another aspect of the present invention, an automatic drying method for a drum type washing machine and dryer having an upper temperature sensor A1 and a lower temperature sensor A2 mounted at upper and lower portions of the inside of the duct respectively, for performing a drying cycle by using a difference of temperatures sensed at the upper temperature sensor A1 and the lower temperature sensor A2 respectively, includes the steps of, upon starting the drying cycle, determining a temperature at an inside of a tub of being higher than a first reference set temperature T1, if the temperature at the inside of the tub is higher than the first reference set temperature T1, comparing the difference A1-A2 of temperatures sensed at the upper temperature sensor A1 and the lower temperature sensor A2 respectively to a second reference set temperature T2, and, if the difference A1-A2 of temperatures is higher than the second reference set temperature T2, assuming a laundry amount by calculating a time period starting from beginning of drying to the present time.

Upon finishing the assumption of laundry amount, a step for determining a drying course of user's selection, and determining an additional drying time period is performed.

If the time periods in each of which the temperature difference between A1 and A2 is greater than T2 are t1 <t2 <t3 <t4 <t5 <t6, each of the assumed laundry amounts to be dried is fixed in a unit of an integer, and a value in the middle of one of sections of a range of the laundry amounts to be dried is assumed by linear interpolation from a linear section of a time period defined in a time period in which the temperature difference between A1 and A2 is greater than T2.

In another aspect of the present invention, a drum type washing machine and dryer includes a tub having a tub rotatably mounted therein, a duct of an air circulating passage for drying laundry in the tub, a duct temperature sensor at a lower portion of an inside of the duct, for sensing a temperature, wherein a difference between a maximum temperature sensed at the duct temperature sensor and a temperature sensed at the present time is used, for determination of a laundry amount and dryness of the laundry.

Preferably, the lower temperature sensor is mounted at a position where a temperature sensed thereby vary with temperature change of mixture of cooling water and condensed water held at a lower end of the duct.

In further aspect of the present invention, an automatic drying method for a drum type washing machine and dryer for performing a drying cycle by using a temperature difference of a duct temperature sensor A2 at a lower portion of an inside of a duct, includes the steps of, upon starting the drying cycle, determining a temperature at the inside of the tub of being higher than a first reference set temperature T1, if the temperature at the inside of the tub is higher than the first reference set temperature T1, obtaining a maximum temperature Tmax of the duct temperature sensor A2, comparing a difference Tmax-A2 of the maximum temperature Tmax and a temperature sensed at the duct temperature sensor A2 to a second reference set temperature T2, and if the difference Tmax-A2 is higher than the second reference set temperature T2, calculating a time period from starting of drying to the present time, for assuming the laundry amount.

If the time periods in each of which the difference between the maximum temperature Tmax and the temperature detected at the present time at the duct temperature sensor A2 is greater than T2 are t1 <t2 <t3 <t4 <t5 <t6, each of the assumed laundry amounts to be dried is fixed in a unit of an integer, and a value in the middle of one of sections of a range of the laundry amounts to be dried is assumed by linear interpolation from a linear section of a time period defined in a time period in which the difference between the maximum temperature Tmax and the temperature detected at the present time at the duct temperature sensor A2 is greater than T2.

In further aspect of the present invention, an automatic drying method for a drum type washing machine and dryer for performing a drying cycle by using temperatures sensed at a plurality of temperature sensors, includes the steps of calculating a temperature difference C between first, and second temperature sensors at a beginning stage of the drying cycle, determining a sign +/− of the difference, for calculating a corrected temperature of the second temperature sensor, if the temperature of the second temperature sensor becomes higher than a first reference set temperature T1, calculating a difference between the temperature of the first temperature sensor and the corrected temperature of the second temperature sensor, to obtain a dryness determining value Δ, and comparing the dryness determining value Δ and a second reference set temperature T2, and terminating the drying cycle according to a result of the comparison.

The first reference set temperature T1 is set to the same value regardless of the dryness, and the second reference set temperature T2 is set to a value which becomes the higher as the dryness is the higher.

The corrected temperature of the second temperature sensor is obtained by adding the temperature difference C to the temperature of the second temperature sensor if the temperature difference C between first, and second temperature sensors has a + sign and by subtracting the temperature difference C from the temperature of he second temperature sensor if the temperature difference C between first, and second temperature sensors has a − sign.

The step of comparing the dryness determining value Δ and a second reference set temperature T2, and terminating the drying cycle according to a result of the comparison includes the step of determining that a desired dryness is achieved in a case two or more than two times of desired results are obtained in the comparison of the dryness determining value Δ and the second reference set temperature T2.

The temperature difference C between first, and second temperature sensors is obtained after a certain time period is passed from starting of drying.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings;

FIG. 8 illustrates a lookup table for assuming a laundry amount for drying in a drum type washing machine in accordance with a first preferred embodiment of the present invention;

FIG. 12 illustrates a lookup table for assuming a laundry amount for drying in a drum type washing machine in accordance with a second preferred embodiment of the present invention;

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A drum type washing machine and dryer and a method for automatic drying by using the same of the present invention will be described in detail.

Figure 1A:
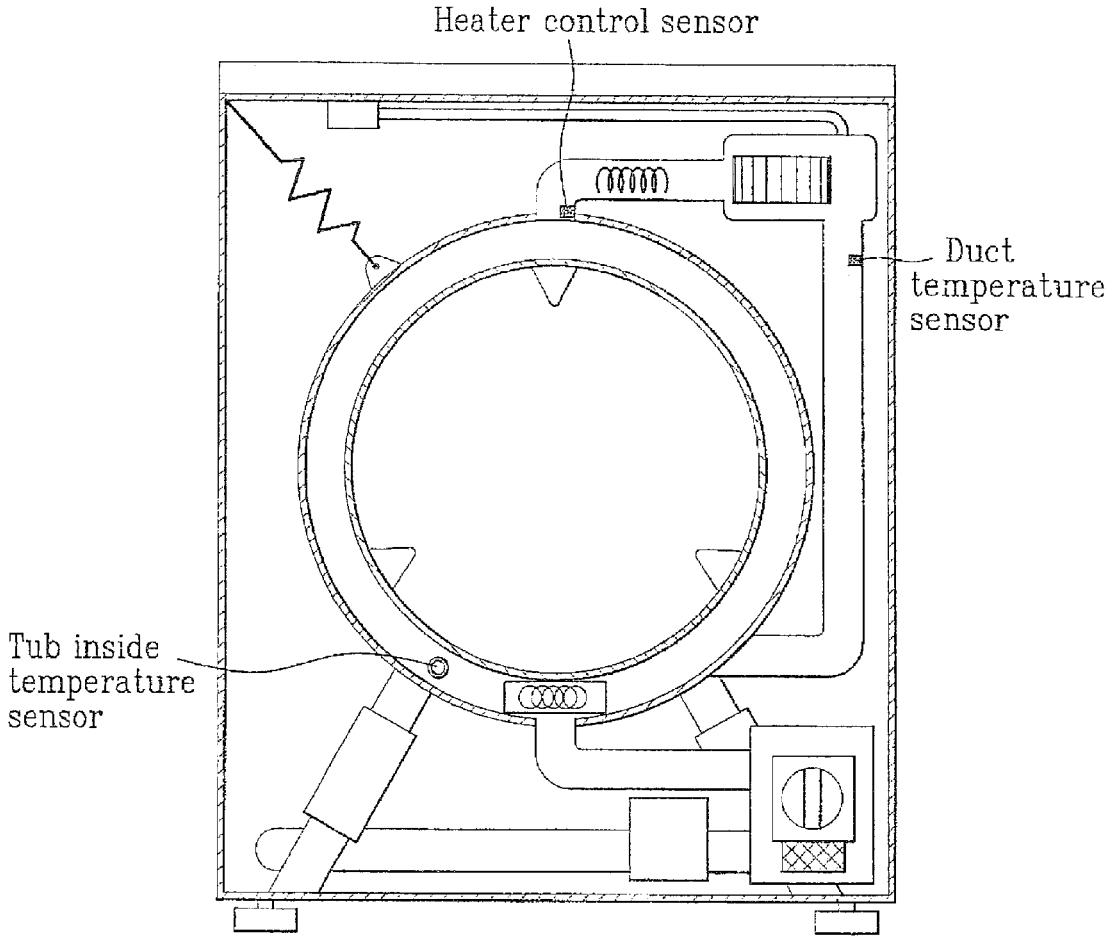
FIG. 1A Related Art
FIGS. 1A and 1B illustrate a diagram of a related art drum type washing machine and dryer, and a graph for explaining an example of a temperature change for determining dryness, respectively.
Figure 1B:
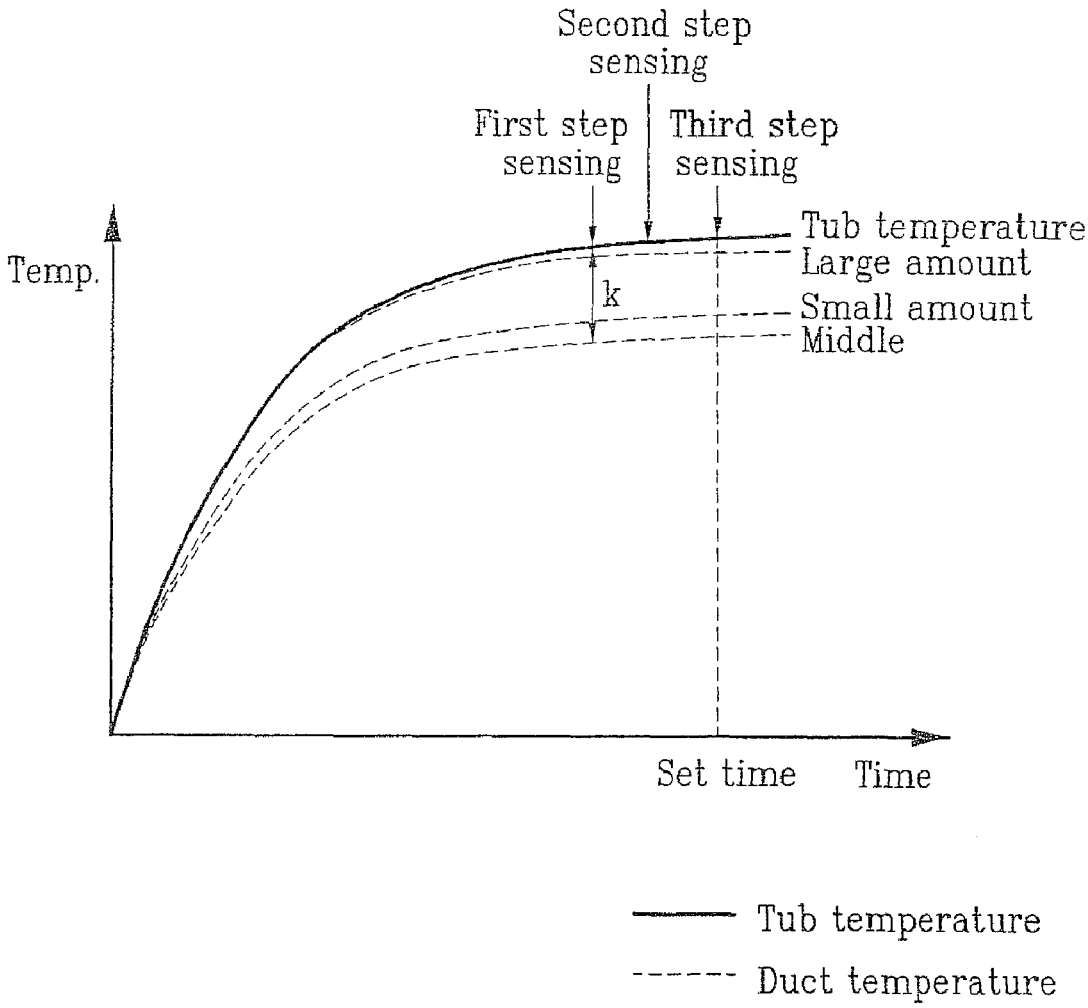
FIG. 1B Related Art
Figure 2:
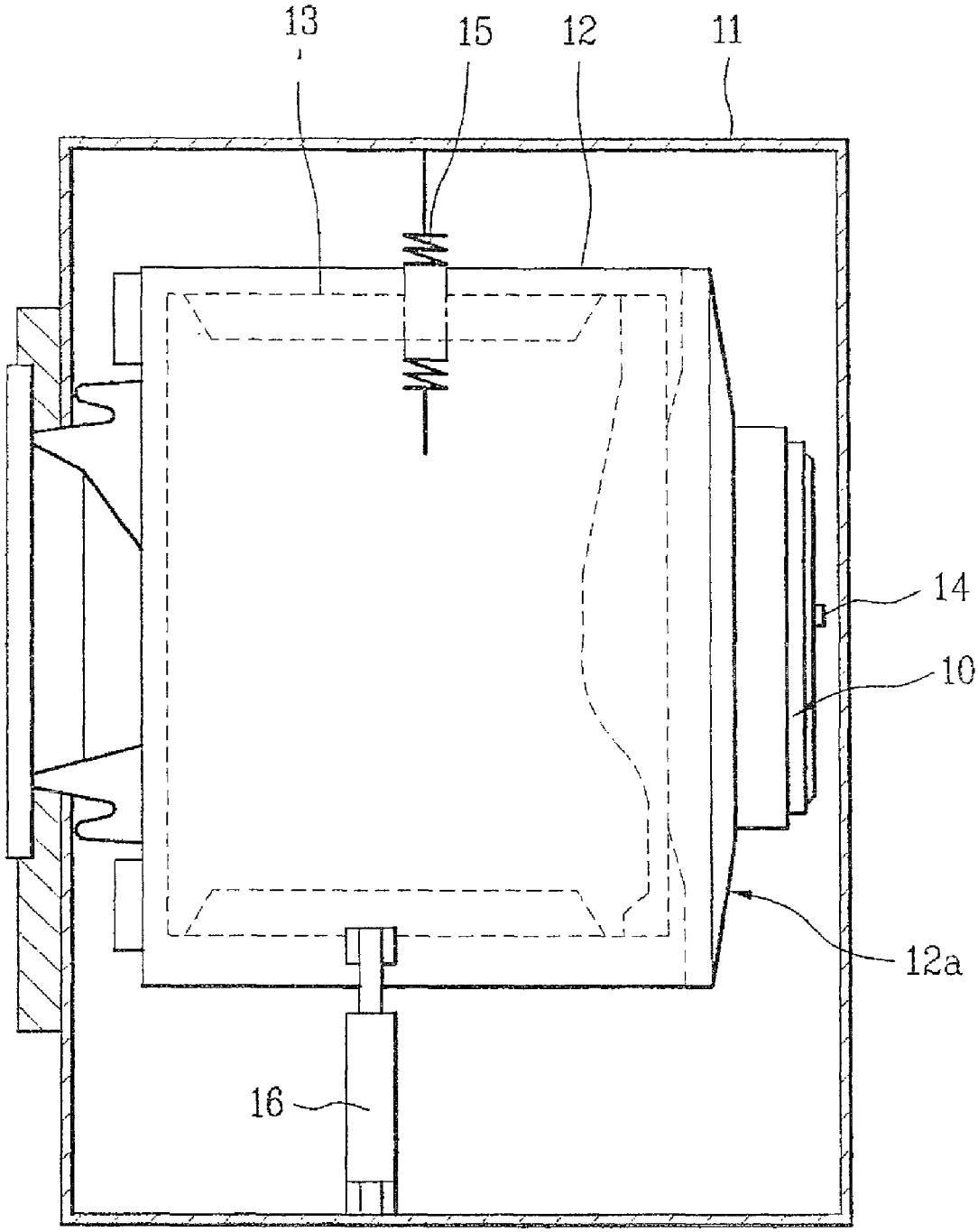
FIG. 2 illustrates a side sectional view of an example of a drum type washing machine and dryer having a duct of the present invention applied thereto, schematically.
Figure 3:
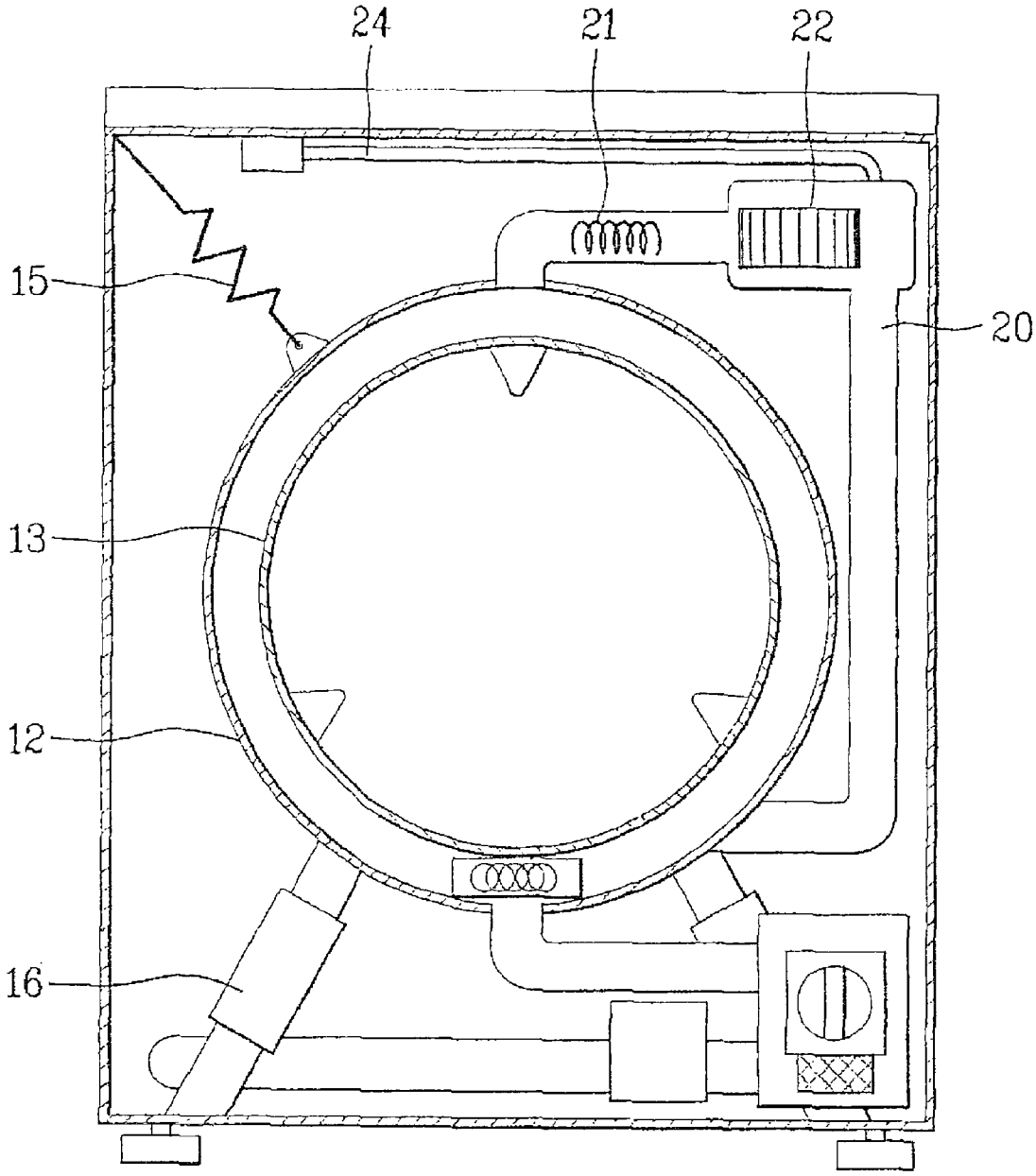
FIG. 3 illustrates a front sectional view of the drum type washing machine in FIG. 2.

FIGS. 2 and 3 each illustrates a drum type washing machine of the present invention, including a cylindrical tub 12 in a cabinet 11, and a cylindrical drum 13 in the tub 12.

There is a driving shaft 14 having a front end connected to a spider (not shown) fixedly secured to a rear of the drum 13, and a rear end passed through a center of the tub 12, and connected to a rotor of the motor 10 on an outside of a rear wall 12*a* of the tub 12.

Accordingly, when power is applied to a stator of the motor 10, the rotor of the motor 10 rotates, to rotate the driving shaft 14, accordingly.

In the meantime, between an inside of an upper portion of the cabinet 11, and an upper portion of an outside circumference of the tub 12, there are suspension springs for supporting the tub 12, and between an inside of a bottom of the cabinet 11 and an underside of the outside circumferential surface of the tub 12, there are friction dampers 16 for damping vibration of the tub 12 occurred at the time of spinning.

In the meantime, the drum type washing machine includes drying means for performing a drying cycle, having a heated air circulating flow passage at one side of the tub 12 with a duct 20 both ends of which are connected to a front and a rear of the tub 12, and a fan 22 and a heater 21 in the duct 20 extended to an upper side of the tub 2 for heating air blown by a fan 22.

Above a vertical portion of the duct 20, there is a cooling water supply pipe 24 for supplying cooling water for condensing hot and humid air circulating through the duct 20 and the tub 12.

In the foregoing drum type washing machine and dryer, in order to determine an accurate and detailed laundry amount, and achieve a dryness a user desires, the present invention suggests to provide a temperature sensor to an inside of the duct for performing an automatic drying algorithm.

Of course, it is apparent that the technology and the drying algorithm of the present invention are applicable, not only to the foregoing system, but also washing machines having other structures.

Figure 4A:
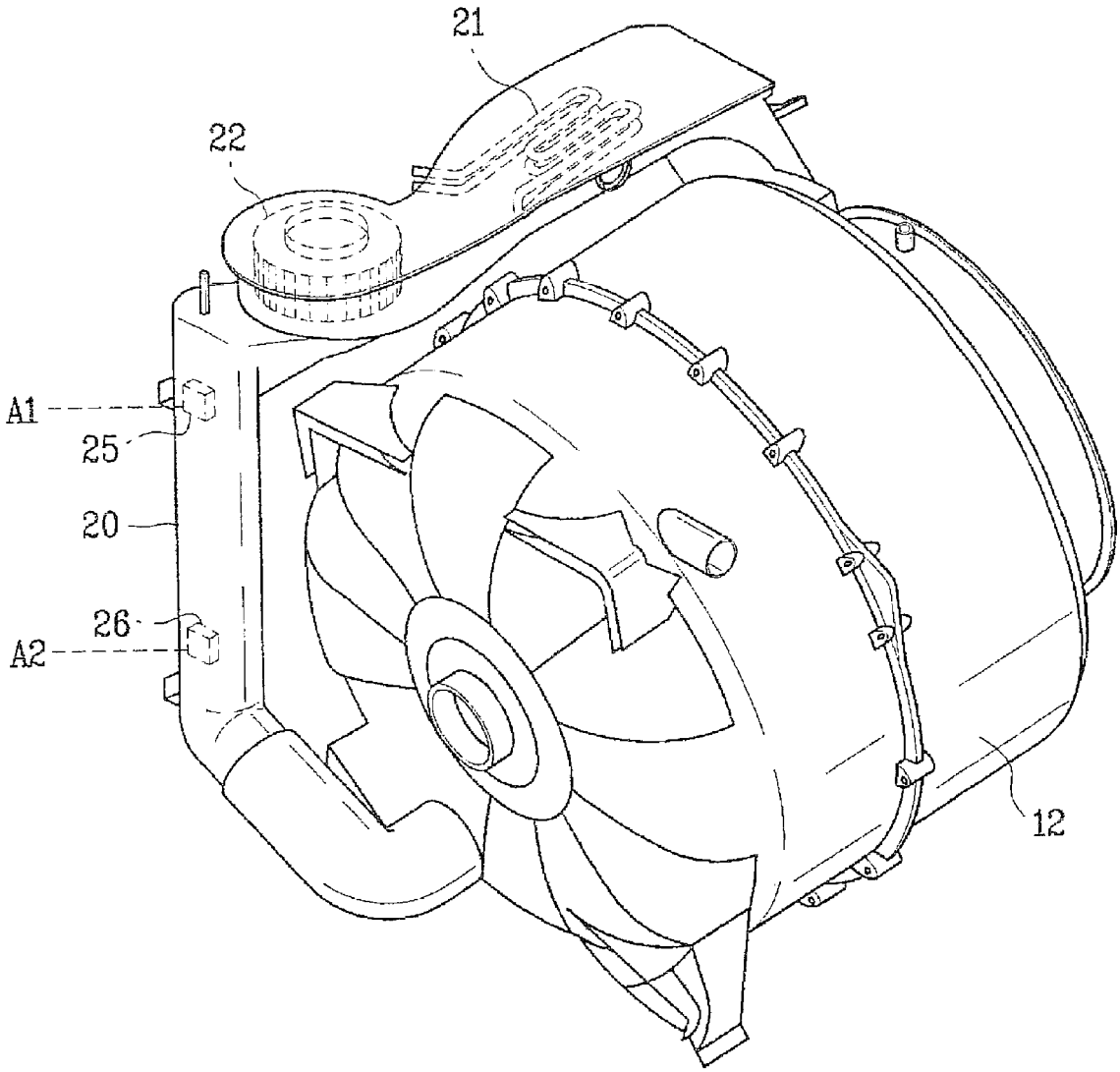
FIGS. 4A and 4B illustrate a perspective view of a drum type washing machine in accordance with a first preferred embodiment of the present invention, and a diagram of the same in a different view with positions of sensors.
Figure 4B:
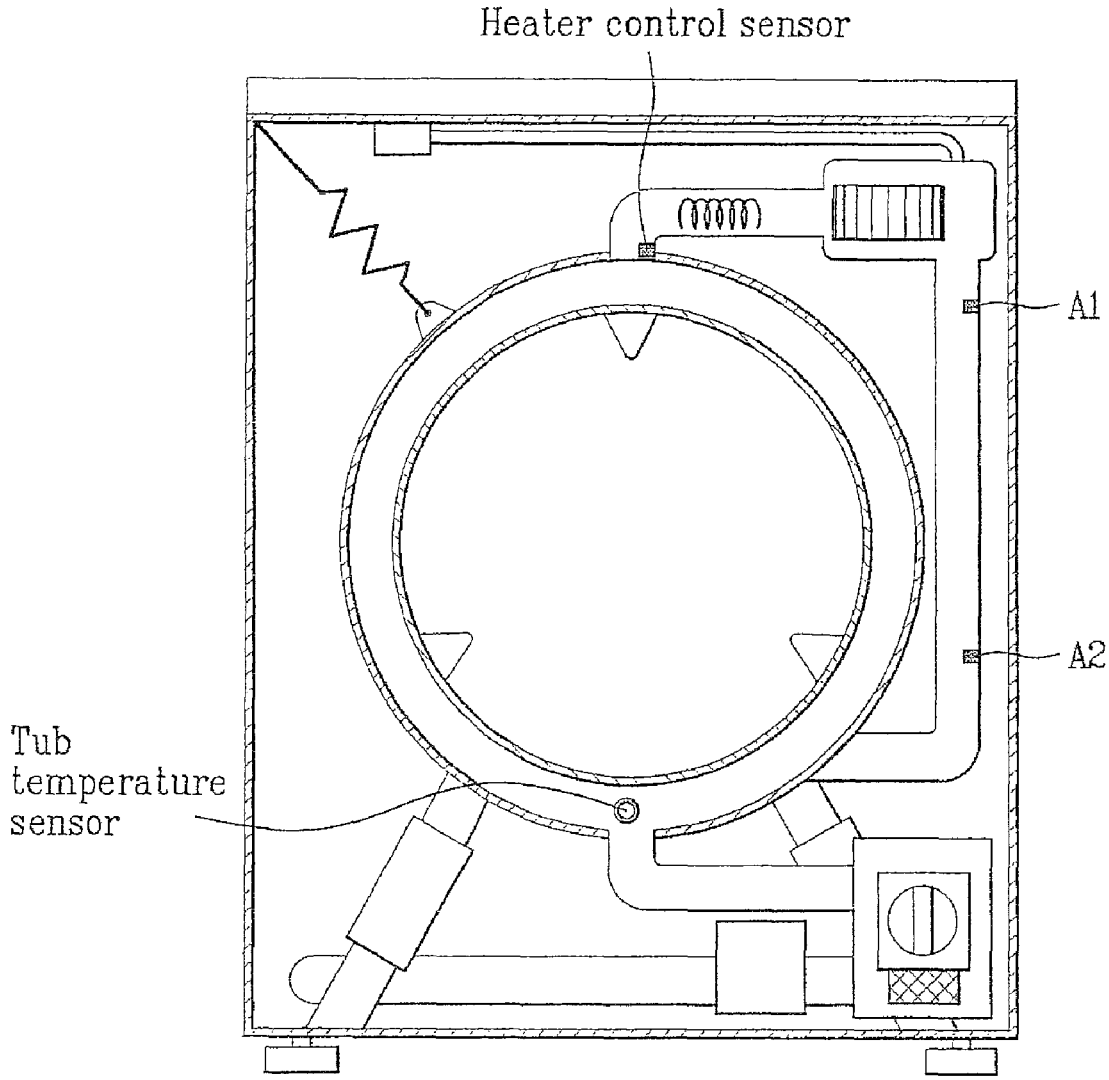

FIGS. 4A and 4B illustrate a perspective view of a drum type washing machine in accordance with a first preferred embodiment of the present invention, and a diagram of the same in a different view with positions of sensors.

The drum type washing machine of the present invention includes an upper temperature sensor 25 and a lower temperature sensor 26 in an upper portion and a lower portion of an inside of a vertical portion of the duct 20 which forms a circulating flow passage of heated air for use in drying, respectively.

The upper temperature sensor 25 and the lower temperature sensor 26 provide sensed temperatures to a control unit (not shown) of the drum type washing machine in real time, so that the control unit determines a dry progressing situation with reference to the sensed temperatures according to a control algorithm provided thereto in advance, and controls the fan 22 and the heater 21.

A1 and A2 points where the upper temperature sensor 25 and the lower temperature sensor 26 are mounted thereon respectively are positions where temperature changes of the air, and the water having the cooling water and condensed water mixed therewith can be sensed the most appropriately.

Positions of the temperature sensors required for performing the dry algorithm in the drum type washing machine and dryer of the present invention are shown in FIG. 4B.

In this instance, sensors required for determining an accurate and detailed laundry amount, and achieving a dryness the user desires according to the determined laundry amount are the upper temperature sensor 25 at A1 and the lower temperature sensor 26 at A2.

The temperature sensors are mounted at A1 point and A2 point respectively under the following reason.

As the drying cycle comes closer to an end, a temperature difference between A1 point and A2 point become distinctive, because condensed water held in a lower portion of the duct 20 through a process in which the heated air absorbs moist from the laundry, and passes through and condensed in the duct 200 is reduced as the drying comes closer to an end, to drop a temperature at A2 compared to a temperature at A1.

The present invention provides the temperature sensors at A1 and A2 for determining the laundry amount and dryness.

Functions of the upper temperature sensor 25 at A1 and the lower temperature sensor 26 at A2, and a temperature change detection process will be described in detail.

Figure 5A:
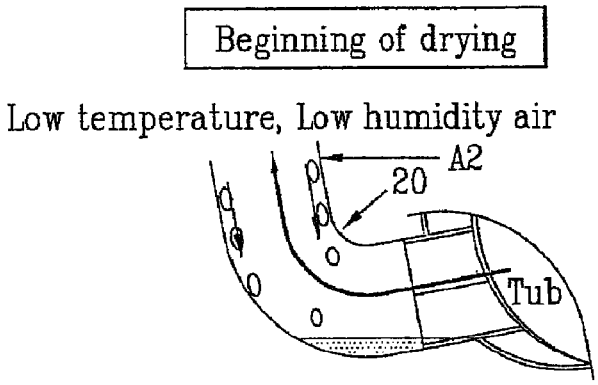
FIGS. 5A to 5C illustrate diagrams for explaining temperature change detection and condensing processes in a drying process of the drum type washing machine of the present invention.
Figure 5B:
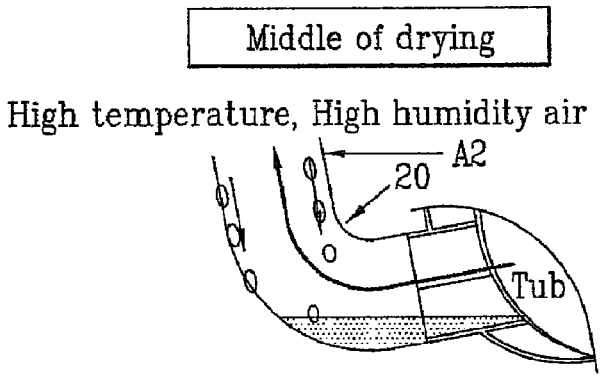
Figure 5C:
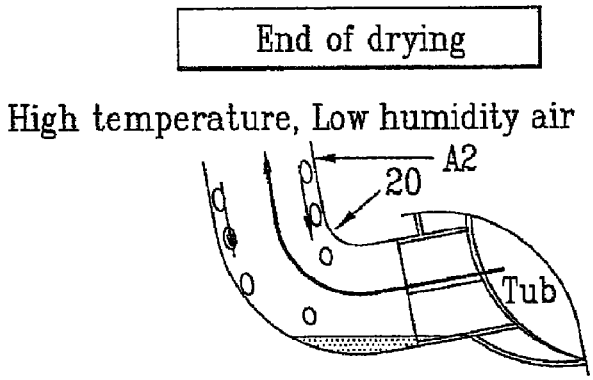
Figure 6:
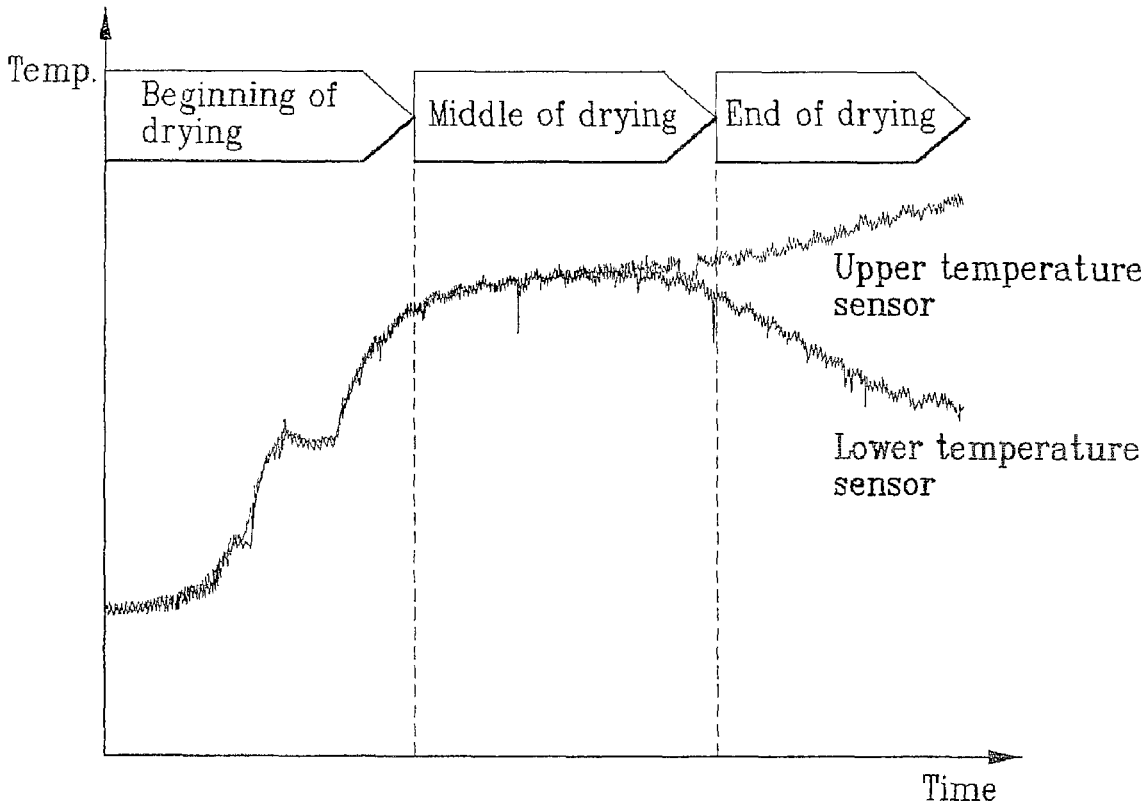
FIG. 6 illustrates a graph for explaining an example of a duct temperature change for dryness determination in a drum type washing machine in accordance with a first preferred embodiment of the present invention.

FIGS. 5A to 5C illustrate diagrams for explaining temperature change detection and condensing processes in a drying process of the drum type washing machine of the present invention, and FIG. 6 illustrates a graph for explaining an example of a duct temperature change for dryness determination in a drum type washing machine in accordance with a first preferred embodiment of the present invention.

In a condensing dry method, the laundry is dried as a process is repeated, in which high temperature, low humidity air is introduced into the tub after finish of the spinning cycle, the air introduced into the tub absorbs moist from the laundry, to turn into a high temperature, high humidity air, and the high temperature, high humidity air is condensed into a low temperature, low humidity air in a condensing process as the air passes through the duct.

The air turned into low temperature, low humidity air in the condensing process is turned into high temperature, low humidity air by the heater, and introduced into the tub, again.

The temperature change at A2 point in the foregoing drying process is as follows.

Referring to FIG. 5A, at beginning of drying, because the laundry in the tub contains much moist, the cooling water and condensed water collected at a lower end of the duct 20 after the low temperature, low humidity air passes through the duct has not so much quantity.

In this state, there is almost no temperature difference between A1 and A2.

Referring to FIG. 5B, at the middle of drying, as the temperature of the tub is in an elevated state following continued supply of heated high temperature air thereto for removing moist from the laundry in the tub, high temperature, high humidity air passes through the duct 20.

In this instance, an amount of the condensed water is greater than an amount of the cooling water at the lower end of the duct 20, to have a high temperature state by the influence.

Referring to FIG. 5C, at an end of drying, when most of the moist is removed from the laundry to a certain level, high temperature, low humidity air passes through the duct 20.

In this instance, the lower end of the duct 20 has a small amount of the condensed water and a great amount of the cooling water, to have a low temperature state by the influence.

In this state, there is a temperature difference between A1 and A2, because the great amount of the cooling water influences the lower temperature sensor at A2 point.

Thus, the drying cycle is progressed, and the temperature changes at A1 and A2 are as follow.

Referring to FIG. 6, at the beginning and middle of drying, the temperatures measured at the upper temperature sensor 25 and the lower temperature sensor 26 show almost the same profiles until the end of drying when the temperature measured at the lower temperature sensor 25 drops slowly, and the temperature measured at the upper temperature sensor rises slowly, such that a temperature difference between the two temperatures becomes greater, gradually.

The temperatures show such profiles because the high temperature, low humidity air becomes to circulate through the tub 12 and the duct 20 at the end of drying as the end of drying has a state almost all moist is removed, such that, of the condensed water and the cooling water held at a bent portion of the lower end of the duct 20, the amount of the condensed water is relatively reduced and the amount of the cooling water which is at a relatively low temperature is increased, leading to reduce an environmental temperature of the lower temperature sensor 26 owing to the temperature of the cooling water.

Therefore, once the temperature difference of the temperatures sensed at the two temperature sensors is greater than a preset value, determining that the drying cycle comes close to an end, the control unit determines an initial dryness from a drying time period from starting of the drying cycle to the present time, senses a laundry amount by using a correlation table of a drying time period versus laundry amount set up at the control unit in advance, determines an additional drying time period required for a particular drying course, and performs the drying cycle.

A process for progressing a drying cycle of the drum type washing machine and dryer of the present invention having the upper temperature sensor, and the lower temperature sensor for sensing the duct temperature following progress of the drying cycle will be described in detail.

Figure 7:
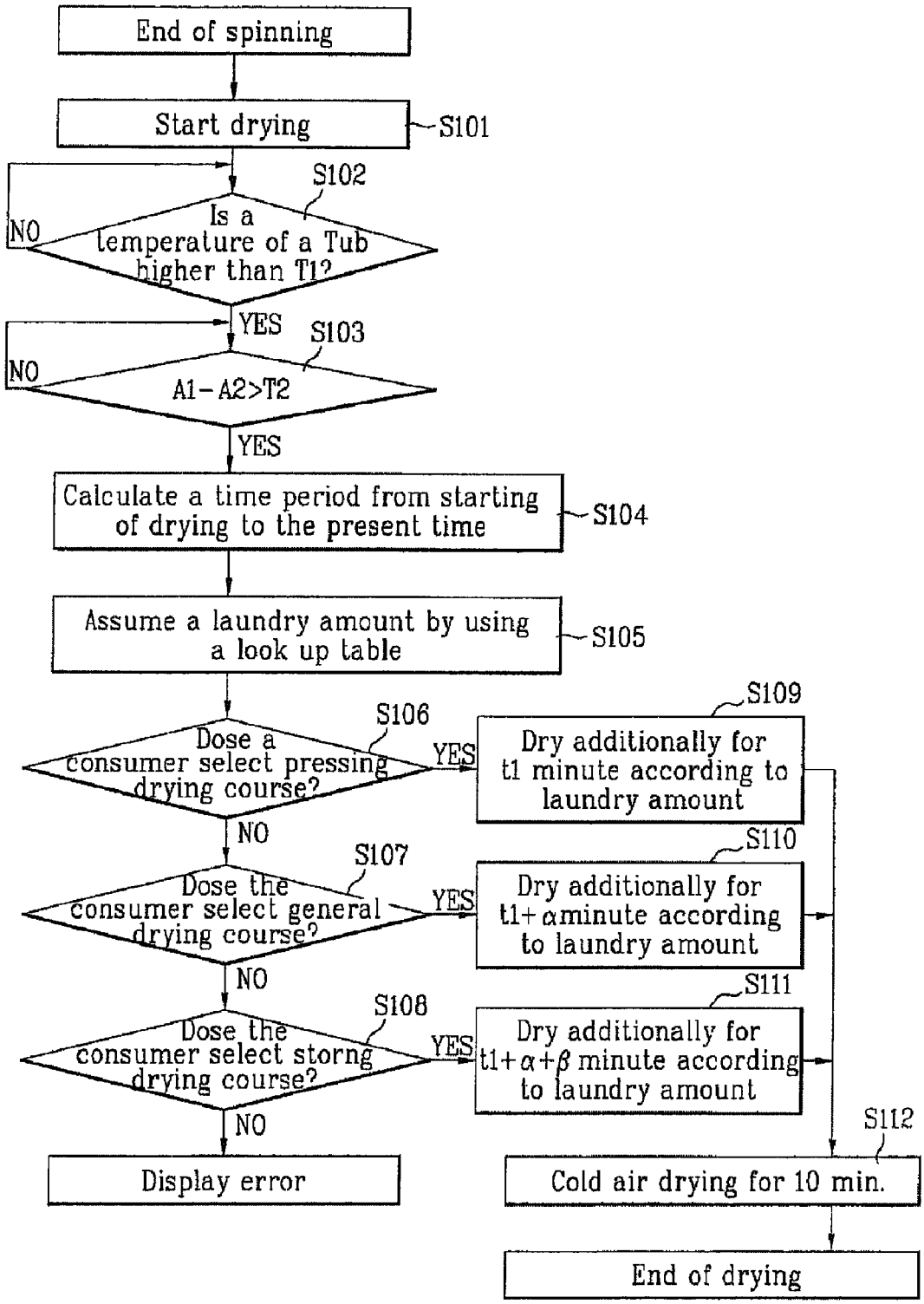
FIG. 7 illustrates a flow chart of a drying algorithm for a drum type washing machine in accordance with a first preferred embodiment of the present invention.

FIG. 7 illustrates a flow chart of a drying algorithm for a drum type washing machine in accordance with a first preferred embodiment of the present invention, and FIG. 8 illustrates a lookup table for assuming a laundry amount for drying in a drum type washing machine in accordance with a first preferred embodiment of the present invention.

Upon starting a drying cycle (S101) after spinning of laundry is finished, it is determined whether a temperature in a tub is higher than a first reference set temperature T1 or not (S102).

The temperature in a tub of being higher than a first reference set temperature T1 or not is determined for preventing wrong determination of a laundry amount and dryness due to reaction of the upper temperature sensor and the lower temperature sensor in the duct to an initial abnormal temperature change, thereby making a temperature sensing at a stable section.

In this instance, the first reference set temperature T1 is set to be 58° C.

If the tub temperature becomes higher than the first reference set temperature T1, in order to determine a moist content of the laundry, it is determined whether a difference of a temperature detected at the upper temperature sensor A1, and a temperature detected at the lower temperature sensor A2 is greater than a second reference set temperature T2 (S103).

Referring to FIG. 6, the difference of a temperature detected at the upper temperature sensor A1, and a temperature detected at the lower temperature sensor A2 of being greater than the second reference set temperature T is determined for determining the present dry state by using that the difference of the temperatures becomes great at A1 and A2 at the end of drying.

Then, if the difference of a temperature detected at the upper temperature sensor A1, and a temperature detected at the lower temperature sensor A2 becomes greater than the second reference set temperature T, a time period from starting of drying to the present time is calculated (S104).

Upon calculating a drying progressed time period thus, a laundry amount is assumed from the lookup table as shown in FIG. 8 as an example (S105).

Upon finishing assumption of the laundry amount, a drying course the consumer selected is determined.

For an example, it is determined in succession that if the consumer selects a pressing dry course (S106), a general dry course (S107), or a strong dry course (S108).

For an example, if the consumer selects the pressing dry course, because the laundry is required to contain moist suitable for pressing, an appropriate time period t1 is added according to the laundry amount in the drying (S109), and a certain time period (about 10 minutes) of cold air drying is performed before terminating the drying cycle (S112).

If the consumer selects a general dry course, because the laundry is not required to contain moist suitable for pressing, an appropriate time period ($t1+\alpha$) is added further according to the laundry amount in drying (S110), and a certain time period (about 10 minutes) of cold air drying is performed before terminating the drying cycle (S112).

If the consumer selects a strong dry course, because it is required to remove more moist from the laundry, the drying is performed additionally for an appropriated time period ($t1+\alpha+\beta$) according to the laundry amount (S111), and a certain time period (about 10 minutes) of cold air drying is performed before terminating the drying cycle (S112).

Determination of the drying time period by using the lookup table according to assumption of laundry amount will be described, further.

Referring to FIG. 8, when a time period in which the temperature difference between A1 and A2 is greater than T9 is t1, t2 ($t1+\alpha1$), t3($t1+\alpha1+\alpha2$), t4($t1+\alpha1+\alpha2+\alpha3$), t5($t1+\alpha1+\alpha2+\alpha3+\alpha4$), or t6($t1+\alpha1+\alpha2+\alpha3+\alpha4+\alpha5$), the assumed laundry amount to be dried may be determined to be 1 kg, 2 kg, 3 kg, 4 kg, 5 kg, or 6 kg, respectively.

The additional drying time period is varied with the drying course of the pressing dry course, the general dry course, and the strong dry course, over the time period in which the temperature difference between A1 and A2 is greater than T9.

A value in the middle of one of sections of a range of the laundry amounts to be dried is assumed by defining a linear section of the time period in which the temperature difference between A1 and A2 is greater than T2.

For an example, if a time period in the middle of the 2 kg, and 3 kg is detected, a linear interpolation is made for each of sections as $t=(t2+t3)/2$, $\beta2.5=(\beta21+\beta31)/2$, $\beta2.5=(\beta22+\beta32)/2$, or $\beta2.5=(\beta23+\beta33)/2$ in assuming the laundry amount.

The assumption of the laundry amount and determination of the drying time period according to the time period in which the temperature difference between A1 and A2 is greater than T2 is not limited to FIG. 8, but other methods are also viable.

The method for determining dryness and laundry amount by using a duct temperature change enables accurate dryness and laundry amount determination, and has consistency for an entire range of laundry amount because the method is based on a moist content of hot air discharged from the tub as the drying progresses, and an amount of condensed water according the moist content.

Taking an economic aspect of the drum type washing machine and dryer and the automatic drying method by using the same of the present invention into account, it is also possible that only one of the temperature sensor may be provided to the duct.

Figure 9A:
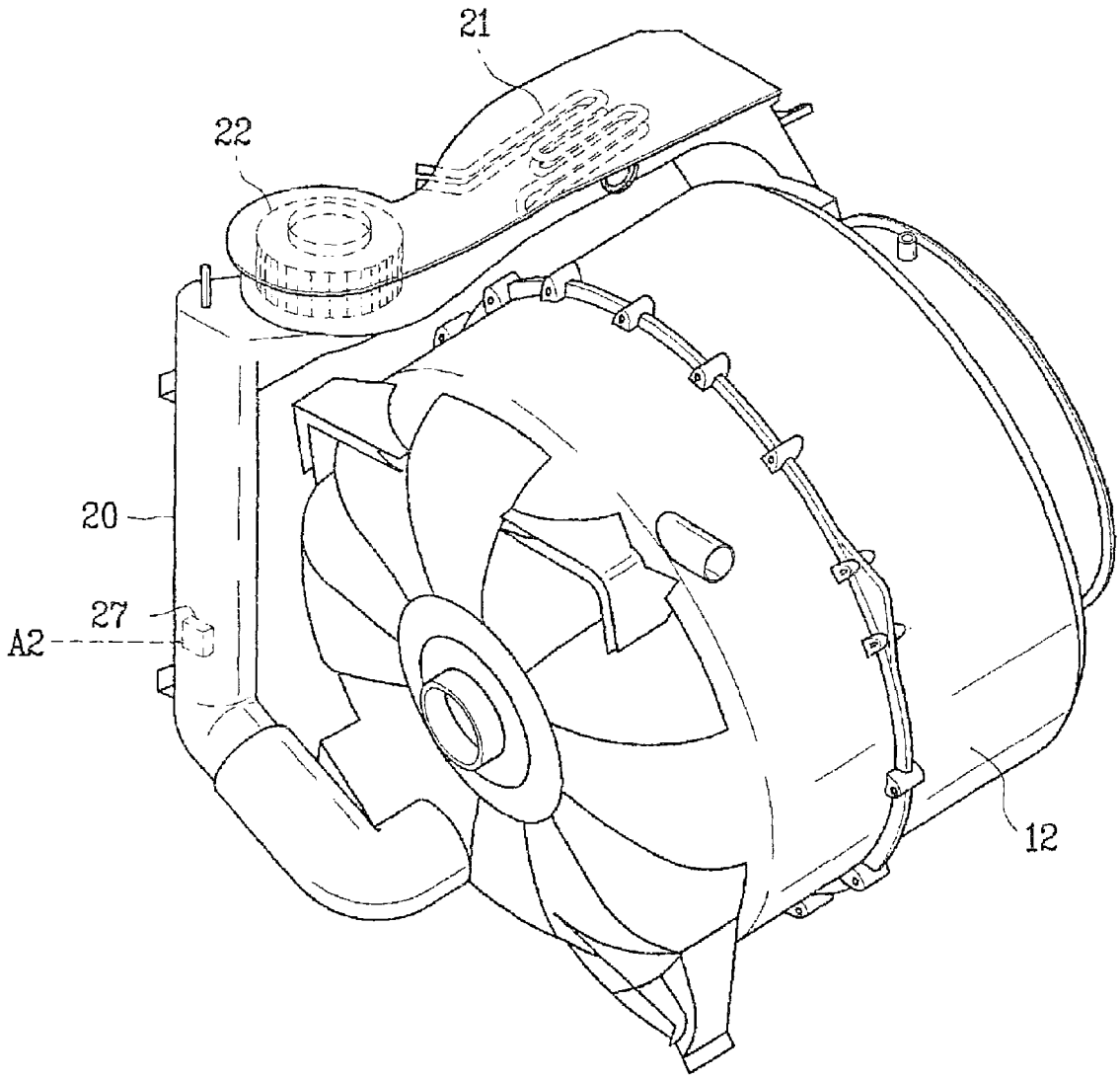
FIGS. 9A and 9B illustrate a perspective view of a drum type washing machine in accordance with a second preferred embodiment of the present invention and a diagram of the same in a different view with positions of sensors.
Figure 9B:
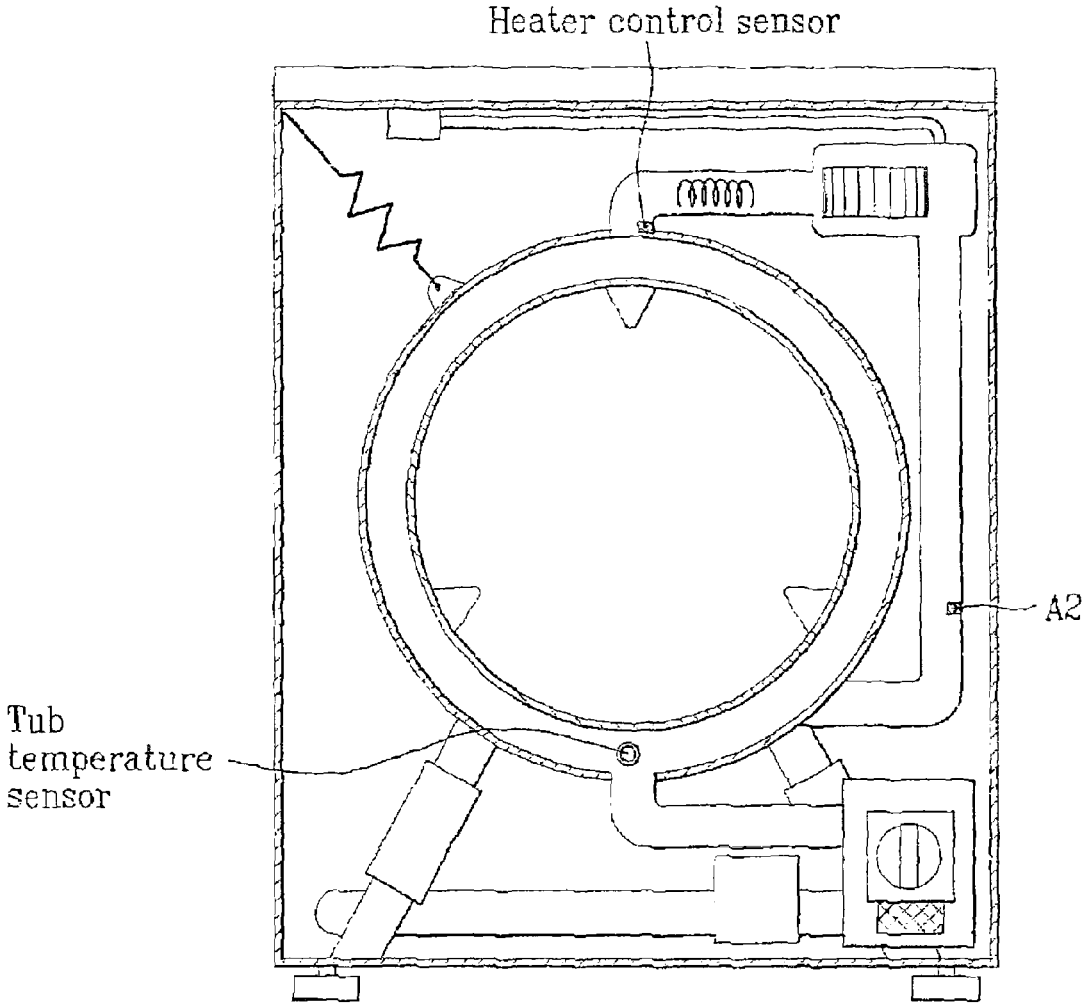
Figure 10:
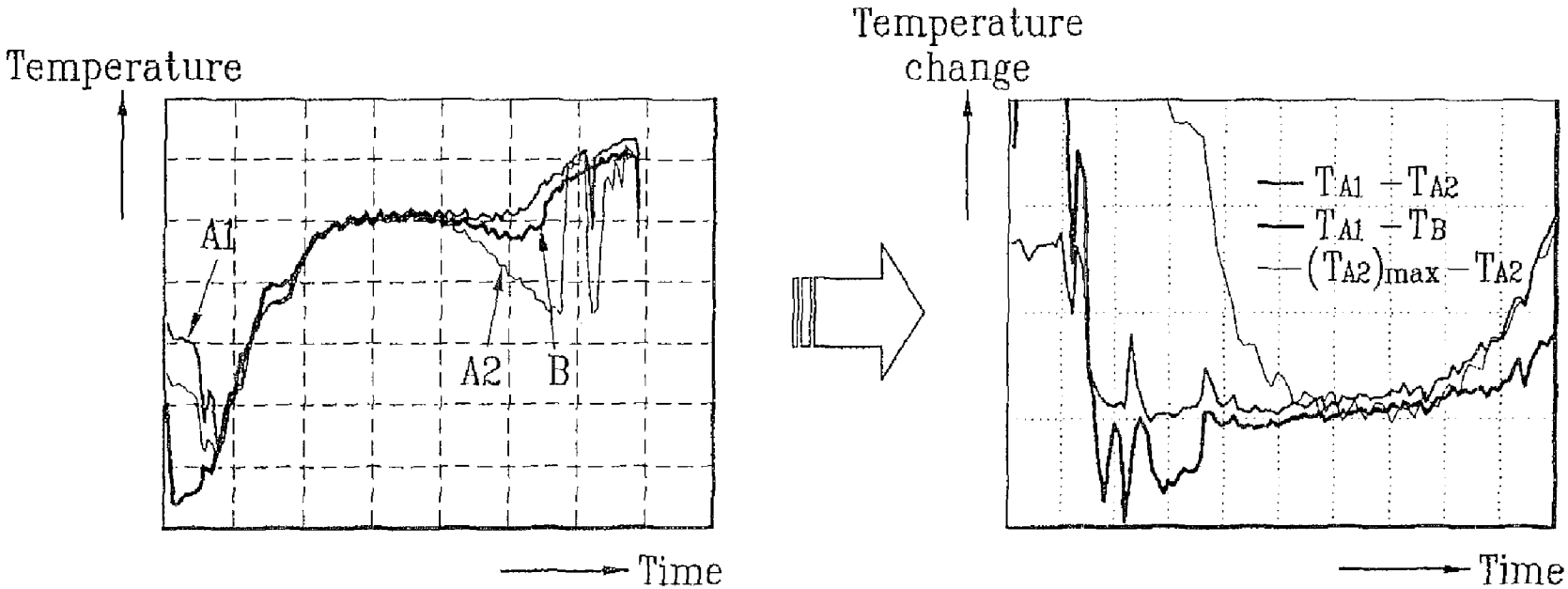
FIG. 10 illustrates a graph for explaining an example of a duct temperature change for dryness determination in a drum type washing machine in accordance with a second preferred embodiment of the present invention.

FIGS. 9A and 9B illustrate a perspective view of a drum type washing machine in accordance with a second preferred embodiment of the present invention, and a diagram of the same in a different view with positions of sensors, and FIG. 10 illustrates a graph for explaining an example of a duct temperature change for dryness determination in a drum type washing machine in accordance with a second preferred embodiment of the present invention.

Referring to FIG. 10, in the second preferred embodiment of the present invention, a small temperature change at A1 and a great temperature change at A2 at an end of drying is utilized, wherein a laundry amount is assumed, and the dryness is determined according to the temperature change at A2 for performing an entire drying cycle.

Alike the first preferred embodiment of the present invention, a position of A2 is fixed as a position where condensed water and cooling water are mixed to enable the most accurate temperature change of an environment of water at the lower portion of the duct.

Referring to FIG. 9A, a duct temperature sensor 27 is mounted at A2 in a duct 20 which is a portion of a circulating flow passage of heated drying air, for transmission of a sensed temperature to a control unit (not shown) of a drum type washing machine and dryer in real time, so that the control unit determines a drying progress situation with reference to the sensed temperature according to a control algorithm set therein in advance, and controls operation of the fan 22 and the heater 21.

FIG. 9B illustrates positions of temperature sensors required for performing the drying algorithm in accordance with a second preferred embodiment of the present invention.

In the second embodiment of the present invention, a maximum temperature of A2 point is measured with the duct temperature sensor 27 after a certain time is passed from starting of the drying cycle.

If the maximum temperature of the A2 point is detected, a laundry amount is determined by using a drying time period up to the present time if a difference of the present temperature at A2 point and the maximum temperature becomes $\Delta T$, and additional drying is progressed with reference to the determined laundry amount for accomplishing the dryness the consumer desires.

In this instance, $\Delta T=(T_{A2})_{max}-T_{A2}$

A curve B in a graph in FIG. 10 denotes a temperature detection profile by the tub temperature sensor.

A process of the drying cycle of the drum type washing machine and dryer in accordance with a second preferred embodiment of the present invention having the duct temperature sensor for detecting a temperature change of an inside of the duct as the drying cycle is progressed will be described in detail.

Figure 11:
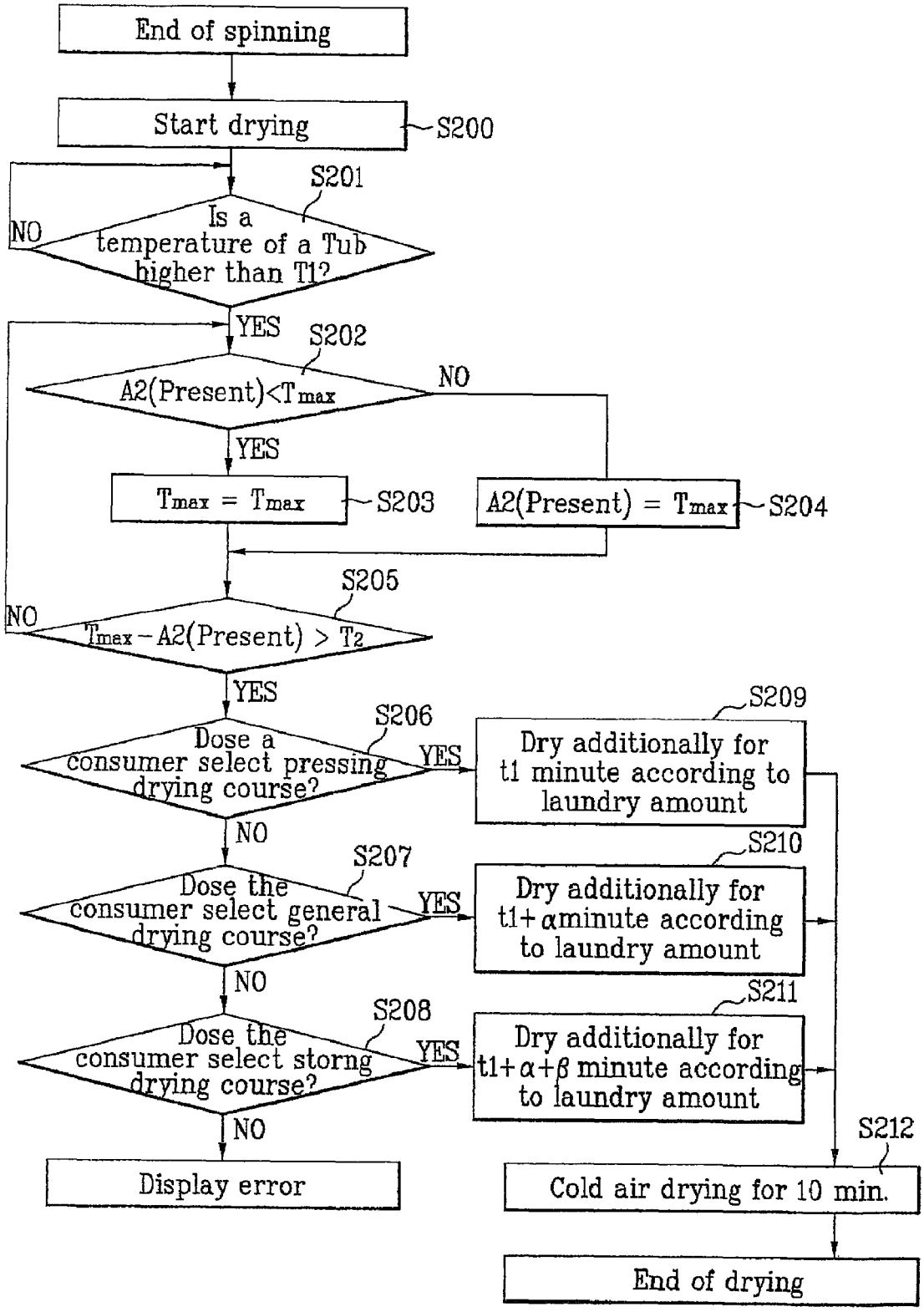
FIG. 11 illustrates a flow chart of a drying algorithm for a drum type washing machine in accordance with a second preferred embodiment of the present invention.

FIG. 11 illustrates a flow chart of a drying algorithm for a drum type washing machine in accordance with a second preferred embodiment of the present invention, and FIG. 12 illustrates a lookup table for assuming a laundry amount for drying in a drum type washing machine in accordance with a second preferred embodiment of the present invention.

Upon finishing spinning cycle, and starting a drying cycle (S200), it is determined whether a tub temperature is higher than T1 (S201).

The tub temperature of being higher than the first reference set temperature T1 is determined for preventing wrong determination of a laundry amount and dryness due to reaction of a duct temperature sensor in the duct to an initial abnormal temperature change.

The first reference set temperature T1 is set to 58° C.

If the tub temperature becomes higher than the first reference set temperature T1, whether the duct temperature detected with the duct temperature sensor 27 at A2 of being maximum or not is determined (S202).

That is, if the duct temperature measured at the present time with the duct temperature sensor A2 is lower than the duct temperature measured before with the duct temperature sensor A2, a highest temperature value detected before is set to Tmax (S203), otherwise the duct temperature measured at the present time with the duct temperature sensor A2 is set to Tmax (S204).

In a state the Tmax is obtained thus, it is determined whether a difference of the maximum temperature Tmax and the duct temperature measured at the present time with the duct temperature sensor A2 is higher than a second reference set temperature T2 (S205).

In the case of S204 in which the present duct temperature is set to Tmax, when Tmax−A2(at the present time) is zero, which can not fulfill the next S205 step, the process is repeated starting from the S202 in which Tmax is determined again.

The difference of the maximum temperature Tmax and the duct temperature measured at the present time with the duct temperature sensor A2 of being higher than the second reference set temperature T2 is determined for determining the present drying state by using drop of the temperature at A2 at the end of drying as shown in FIG. 10.

Then, if the difference between the maximum temperature and the temperature measured at the duct temperature sensor A2 becomes greater than the second reference set temperature T2, a time period from starting of drying to the present time is calculated, and the laundry amount is assumed by using a lookup table as shown in FIG. 12 as an example.

Upon finishing laundry amount assumption thus, a drying course of the consumer's selection is determined.

For an example, the control unit determines whether the consumer selects the pressing dry course (S206), the general dry course (S207), or the strong dry course (S208) in succession.

As an example, if the consumer selects the pressing dry course, because the laundry is required to contain moist suitable for pressing, an appropriate time period t1 is added according to the laundry amount in the drying (S209), and a certain time period (about 10 minutes) of cold air drying is performed before terminating the drying cycle (S212).

If the consumer selects a general dry course, because the laundry is not required to contain moist suitable for pressing, an appropriate time period (t1+α) is added further according to the laundry amount in drying (S210), and a certain time period (about 10 minutes) of cold air drying is performed before terminating the drying cycle (S212).

If the consumer selects a strong dry course, because it is required to remove more moist from the laundry, the drying is performed additionally for an appropriated time period (t1+α+β) according to the laundry amount (S211), and a certain time period (about 10 minutes) of cold air drying is performed before terminating the drying cycle (S212).

Determination of the drying time period by using the lookup table according to assumption of laundry amount will be described, further.

Referring to FIG. 10, when a time period in which a difference between the maximum temperature at A2, i.e., A2(Tmax) and the present temperature at A2 is greater than a second reference set temperature T2 is t1, t2 (t1+α1), t3(t1+α1+α2), t4(t1+α1+α2+α3), t5(t1+α1+α2+α3+α4), or t6(t1+α1+α2+α3+α4+α5), the assumed laundry amount to be dried may be determined to be 1 kg, 2 kg, 3 kg, 4 kg, 5 kg, or 6 kg, respectively.

The additional drying time period is varied with the drying course of the pressing dry course, the general dry course, and the strong dry course, over the time period in which the difference between A2(Tmax) and the present temperature at A2 is greater than T2.

A value in the middle of one of sections of a range of the laundry amounts to be dried is assumed by defining a linear section of the time period in which the difference between A2(Tmax) and the present temperature at A2 is greater than T2.

For an example, if a time period between the 2 kg, and 3 kg is detected, a linear interpolation is taken for each of sections as t=(t2+t3)/2, β2.5=(β21+β31)/2, β2.5=(β22+β32)/2, or β2.5=(β23+β33)/2 in assuming the laundry amount.

The assumption of the laundry amount and determination of the drying time period according to the time period in which the difference between A2(Tmax) and the present temperature at A2 is greater than T2 is not limited to FIG. 10, but other methods are also viable.

The drum type washing machine and dryer and method for automatic drying by using the same enables accurate dryness and laundry amount determination and has consistency for an entire range of laundry amount because the dryness and laundry amount are determined by using temperature changes occurred in the duct as the drying progresses.

A third preferred embodiment of the present invention will be described, in which a step of compensating for a temperature deviation found at the beginning of drying is included thereto to measure an accurate temperature change, for accurate performance of an automatic drying algorithm.

Figure 13:
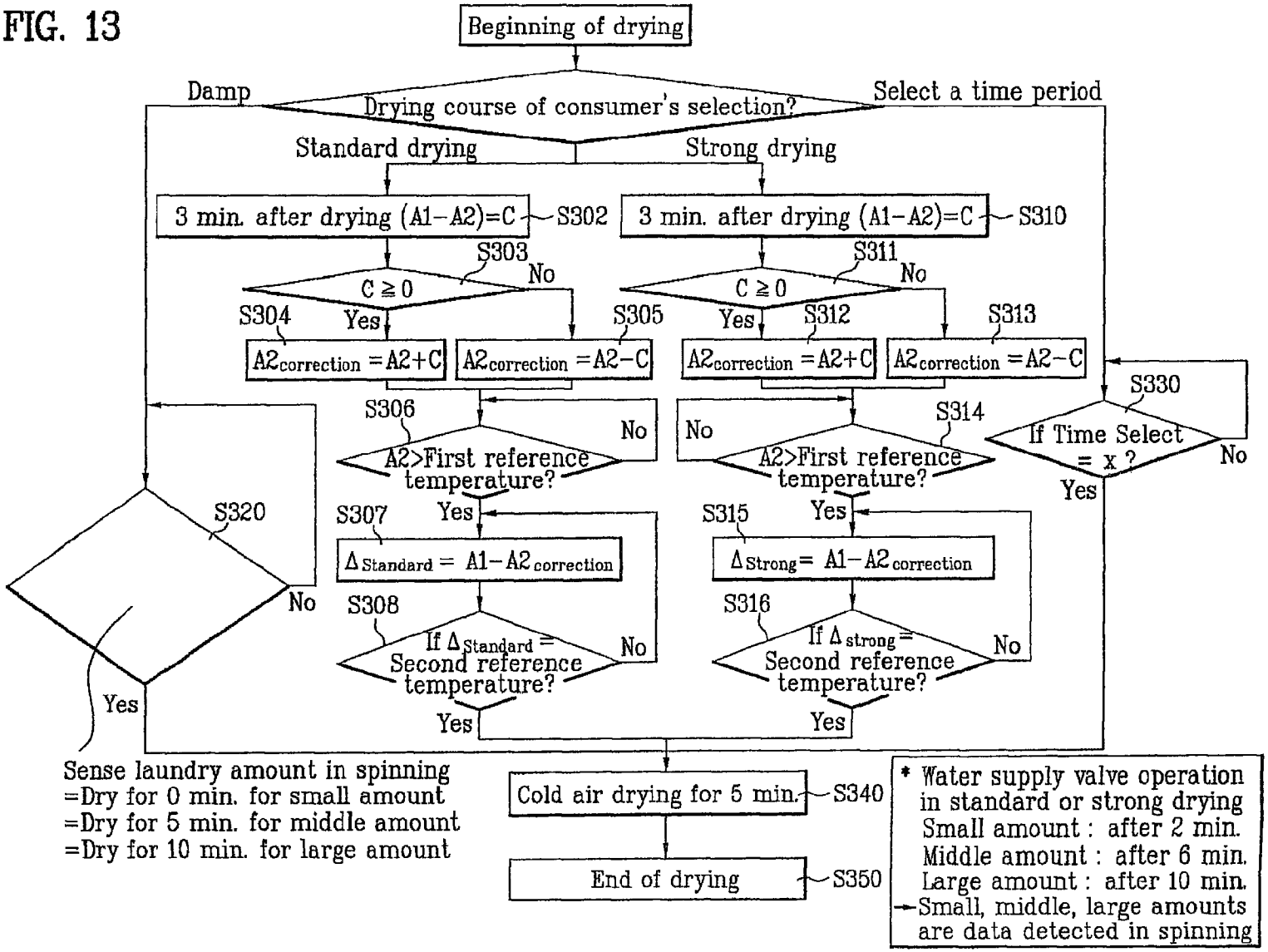
FIG. 13 illustrates a flow chart of a drying algorithm having a temperature deviation compensation function for a drum type washing machine in accordance with a third preferred embodiment of the present invention.
Figure 14A:
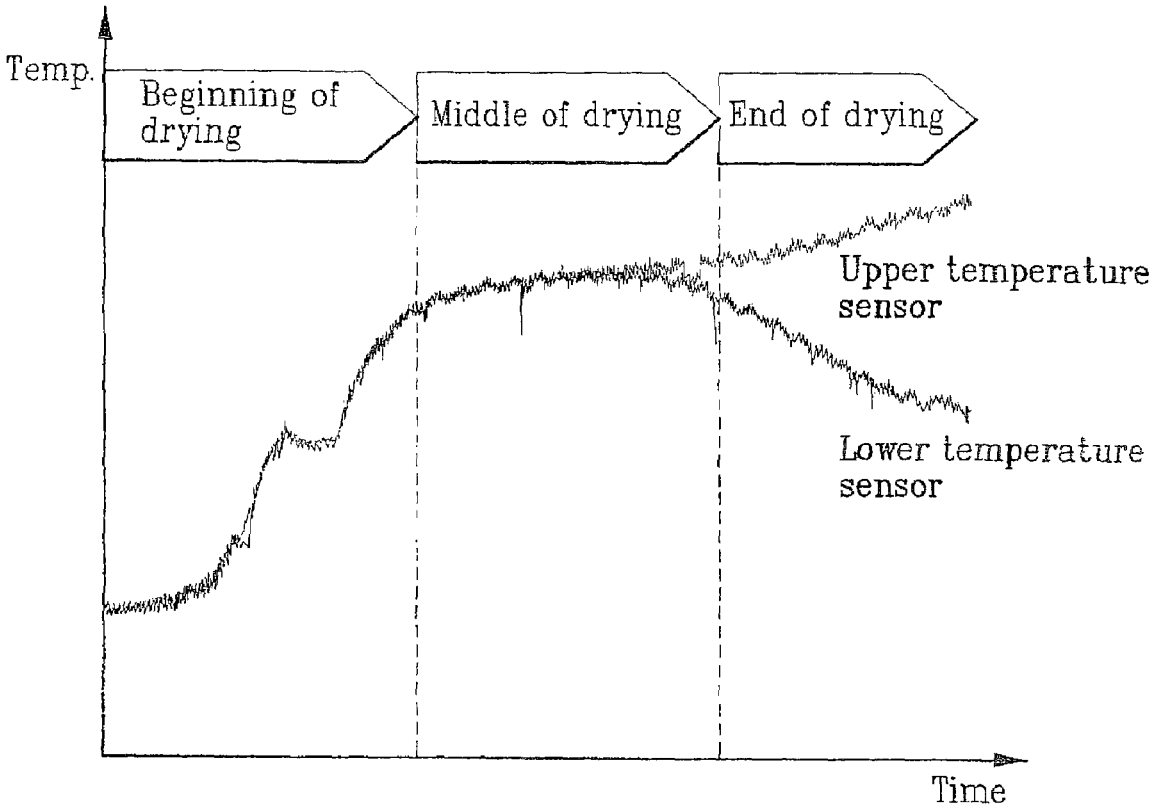
FIGS. 14A to 14C graphs showing an ideal temperature sensing profile and temperature sensing profiles inclusive of an initial deviation.
Figure 14B:
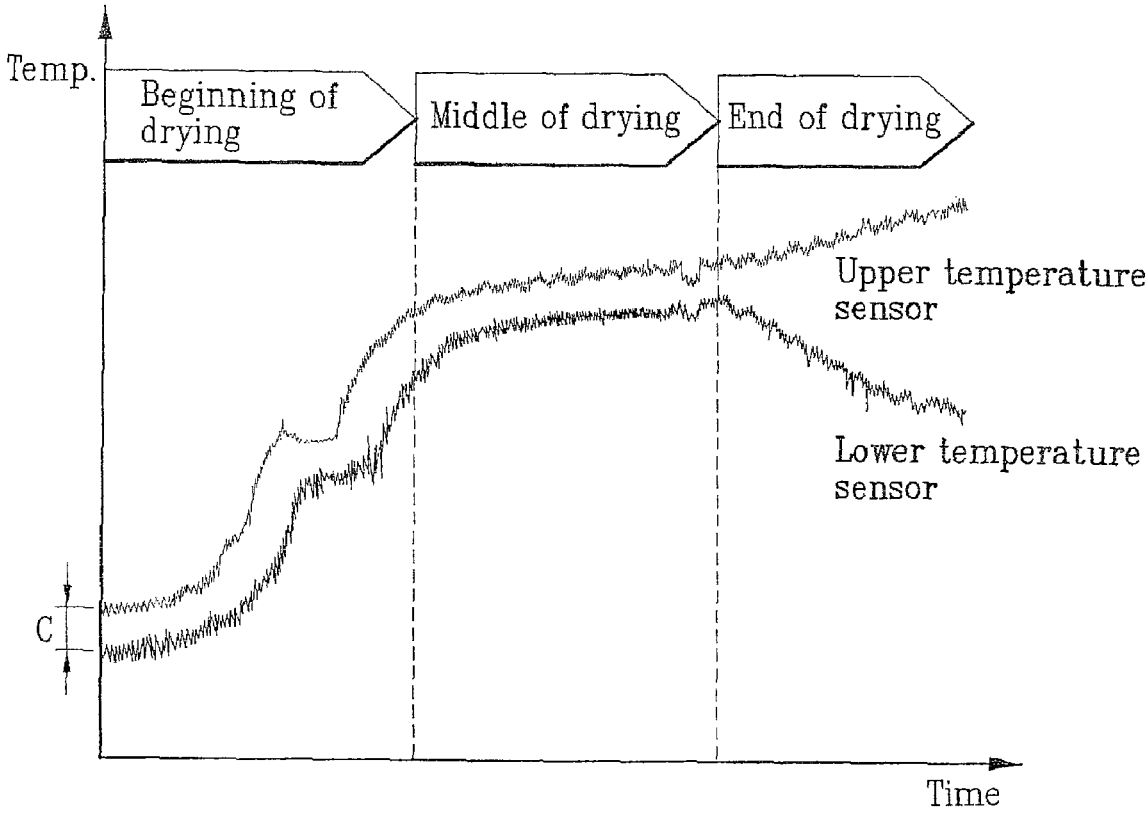
Figure 14C:
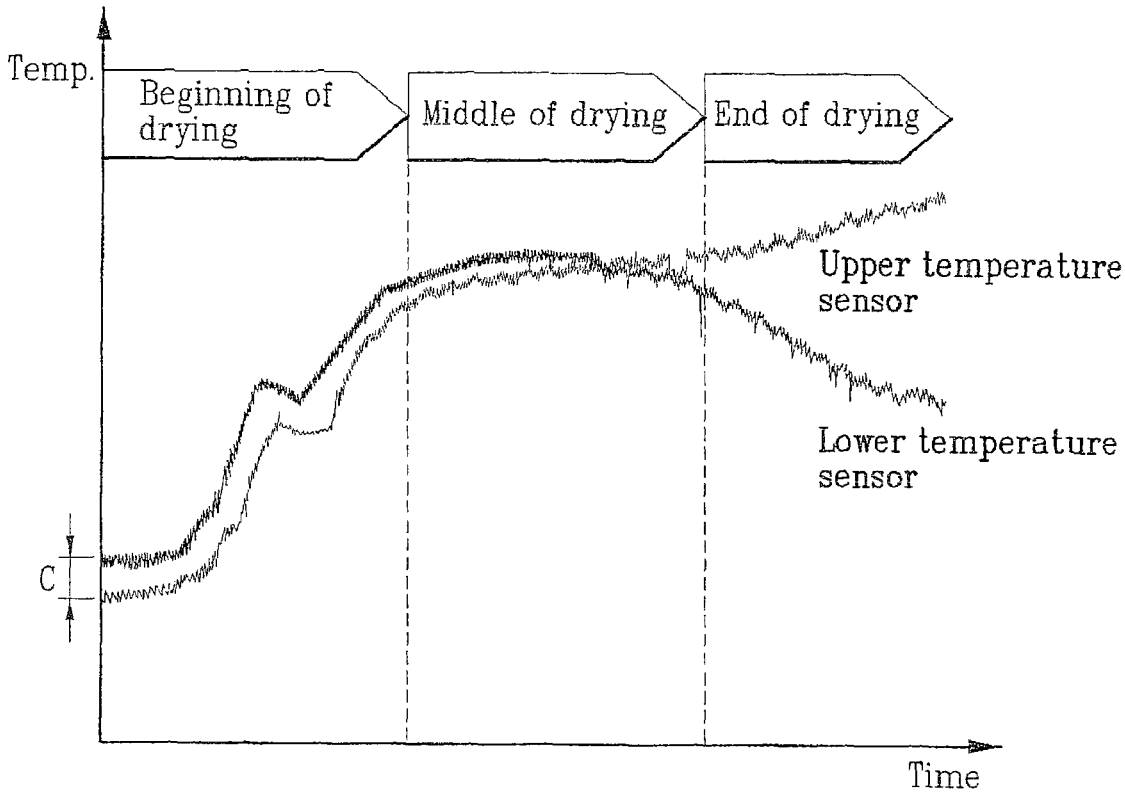

FIG. 13 illustrates a flow chart of a drying algorithm having a temperature deviation compensation function for a drum type washing machine in accordance with a third preferred embodiment of the present invention. FIGS. 14A to 14C graphs showing an ideal temperature sensing profile and temperature sensing profiles inclusive of an initial deviation.

The third embodiment of the present invention includes a step of compensating for a temperature deviation at the time of performing automatic drying, for reducing temperature deviations between test pieces(washing machines), to implement an accurate algorithm for all test pieces.

Upon starting a drying cycle, the drying course selected by the consumer is determined (S301).

If the drying course the consumer selects is a standard drying, a difference 'C' of a temperature sensed at an upper temperature sensor A1 and a temperature sensed at a lower temperature sensor A2 is calculated (S302) for compensating for a temperature deviation occurred at beginning after a certain reference time period is passed caused by deviations of a position of the temperature sensor, and the temperature sensor itself, a deviation of a duct structure, a deviation of heating performance, and so on.

The reference time period is set to three minutes.

A sign (+/−) of the difference is determined (S303), and, if the sign is '+', the difference 'C' is added to the temperature of the lower temperature sensor A2, to obtain a compensated temperature (compensated A2) of the lower temperature sensor (S304).

If the sign is '−', the difference 'C' is subtracted from the temperature of the lower temperature sensor A2, to obtain a compensated temperature (compensated A2) of the lower temperature sensor (S305).

If the temperature of the lower temperature sensor A2 reaches to a first reference temperature (S306), a difference between the temperature of the upper temperature sensor A1 and the temperature (compensated A2) of the lower temperature sensor is calculated, to obtain a Δ standard deviation (a temperature difference for determining the dryness) required for standard drying (S307).

The Δ standard deviation is obtained after the temperature of the lower temperature sensor A2 reaches to the first reference temperature, for progressing the next step after the drying enters into a period in which temperature sensing is made, securely.

The first reference temperature is set to '56° C.

Then, the Δ standard deviation and a second reference temperature, a reference temperature, are compared (S308), to determine a consumer desired dryness is reached if above two values are equal, a five minutes of cold air drying is performed (S340), and the drying cycle is terminated (S350).

The second reference temperature is set to '2° C.'.

In the step of determining the dryness, if the standard dry is a case the dryness ranges 90~100%, it is determined that the dryness is reached in a case the Δ standard deviation (A1-compensated A2) is measured for two times in succession the same with the desired second reference temperature.

This is because one time occurrence of the Δ standard deviation (A1-compensated A2) that satisfies a condition may be caused by noise, i.e., the two time measurement of the Δ standard deviation (A1-compensated A2) is for removing the influence of the noise.

Besides a case when the upper temperature sensor A1 and the lower temperature sensor A2 are used, above condition is also applicable to a case the upper temperature sensor A1 and the tub temperature sensor Tub are used in the same fashion (A1-compensated Tub).

In a case the drying course the consumer selects is the strong drying course too, a difference 'C' of a temperature sensed at an upper temperature sensor A1 and a temperature sensed at a lower temperature sensor A2 is calculated (S310) for compensating for a temperature deviation occurred at beginning after a certain reference time period is passed caused by deviations of a position of the temperature sensor, and the temperature sensor itself, a deviation of a duct structure, a deviation of heating performance, and so on.

The reference time period is set to three minutes after starting the drying cycle.

A sign (+/−) of the difference is determined (S311), and, if the sign is '+', the difference 'C' is added to the temperature of the lower temperature sensor A2, to obtain a compensated temperature (compensated A2) of the lower temperature sensor (S312).

If the sign is '−', the difference 'C' is subtracted from the temperature of the lower temperature sensor A2, to obtain a compensated temperature (compensated A2) of the lower temperature sensor (S313).

If the temperature of the lower temperature sensor A2 reaches to the first reference temperature (S314), a difference between the temperature of the upper temperature sensor A1 and the temperature (compensated A2) of the lower temperature sensor is calculated, to obtain a Δ strong deviation (a temperature difference for determining the dryness) required for the strong drying (S315).

Alikely, the first reference temperature is set to '56° C.

Then, the Δ strong deviation and a second reference temperature, a reference temperature, are compared (S316), to determine a consumer desired dryness is reached if above two values are equal, a five minutes of cold air drying is performed (S340), and the drying cycle is terminated (S350).

The second reference temperature is set to '6° C.'.

In the step of determining the dryness, if the strong dry is a case the dryness ranges 100~105%, it is determined that the dryness is reached in a case the Δ strong deviation (A1-compensated A2) is measured for two times in succession the same with the desired second reference temperature.

This is because one time occurrence of the Δ strong deviation (A1-compensated A2) that satisfies a condition may be caused by noise, i.e., the two time measurement of the Δ strong deviation (A1-compensated A2) is for removing the influence of the noise.

Besides a case when the upper temperature sensor A1 and the lower temperature sensor A2 are used, above condition is also applicable to a case the upper temperature sensor A1 and the tub temperature sensor Tub are used in the same fashion (A1-compensated Tub).

If the drying course the consumer selects is damp course, the drying cycle is performed with reference to the laundry amount sensed in the spinning step progressed before the drying cycle (S320).

That is, after performance of drying for '0' minutes if the laundry amount is small, five minutes if the laundry amount is middle, and ten minutes if the laundry amount is great, cold air drying is performed for five minutes (S340), and the drying cycle is terminated (S350).

If the consumer selects the drying time period, drying is performed for the selected time period (S330), cold air drying is performed for five minutes (S340), and the drying cycle is terminated (S350).

In above description, the first reference temperatures are set to the same regardless of the dryness, and the second reference temperature is set to a value which is the higher as the desired dryness is the higher.

The operation of a water supply valve in performance of the drying algorithm of the present invention is as follows.

In a case of the standard drying or the strong drying, the cooling water required for drying is supplied 2 minutes after starting of drying if the laundry amount is small, 6 minutes after starting of drying if the laundry amount is middle, and 10 minutes after starting of drying if the laundry amount is great.

The laundry amount of this time is the laundry amount sensed in the spinning step progressed before the drying cycle.

The embodiment of the present invention has an advantage of enabling to perform an optimum drying the consumer desires because the method of determining the dryness and the laundry amount by using a temperature change of an inside of the duct is based on moist content of heated air discharged from the tub as the drying progresses, and a temperature change following change of an amount of condensed water due to the moist content of the heated air, thereby enabling an accurate drying.

Moreover, the step of correcting a deviation occurred at beginning of drying enables to measure the temperature change accurately, thereby permitting accurate performance of the automatic drying algorithm.

In the step of correcting a deviation occurred at beginning of drying, an error of a case when the temperature profiles are as shown in FIG. 14B or 14C is corrected (+ or – the C value), for making dryness determination identical to a case when the temperature profile is ideal as shown in 14A.

The drum type washing machine and dryer and method for automatic drying by using the same have the following advantages.

An optimum drying the consumer desires is made available because determination of the laundry amount and dryness is based on moist content of heated air discharged from the tub as the drying progresses, and temperature change due to change of an amount of condensed water according to the moist content.

Second, the availability of an accurate and detailed laundry amount by using the temperature change occurred in the condensing duct as the drying progresses permits an accurate drying even in a case the laundry amount is small, which suppresses excessive drying, to prevent the laundry suffering from damage.

Third, the availability of the consistent and accurate drying for an entire range of laundry amount, and the availability of detailed division of a range of the drying time period permits application to a large capacity drum type washing machine with a capacity 10 Kg or greater to perform the automatic drying algorithm.

Fourth, the step of correcting deviation occurred at beginning of drying permits an accurate measurement of a temperature change, thereby permitting to perform an accurate automatic drying algorithm.

Fifth, the elimination of deviation between test pieces permits to enhance product reliability.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An automatic drying method for a drum type washing machine and dryer having an upper temperature sensor A1 and a lower temperature sensor A2 mounted at upper and lower portions of an inside of a duct that is an air circulating passage for drying laundry, respectively, for performing a drying cycle by using a difference of temperatures sensed at the upper temperature sensor A1 and the lower temperature sensor A2, respectively, the method comprising:

upon starting the drying cycle, determining whether a temperature at an inside of a tub is higher than a first reference set temperature T1;

when the temperature at the inside of the tub is higher than the first reference set temperature T1, determining a temperature difference TA1-TA2 between temperatures TA1 and TA2, wherein TA1 is sensed at the upper temperature sensor A1 and TA2 is sensed at the lower temperature sensor A2, respectively; and assuming a laundry amount that is proportional to a time period starting from when a drying operation is initiated to when a temperature difference of TA1-TA2 becomes a second reference set temperature.

2. The method as claimed in claim 1, further comprising upon finishing the assumption of the laundry amount, determining an additional drying time to the time period using a drying course based upon a user's selection and the laundry amount assumed.

3. An automatic drying method for a drum type washing machine and a dryer having an upper temperature sensor A1 and a lower temperature sensor A2 mounted at an upper portion and a lower portion of an inside of a duct that is an air circulating passage for drying laundry respectively, the method comprising:

determining a temperature difference TA1-TA2 between temperature TA1 sensed at the upper temperature sensor A1 and temperature TA2 sensed at the lower temperature sensor A2; and calculating a laundry amount that is proportional to a time period starting from when a drying operation is initiated to when the determined temperature difference TA1-TA2 becomes a reference set temperature.

4. The method as claimed in claim 3, further comprising determining an additional drying time to the time period that is proportional to the laundry amount.

5. The method as claimed in claim 4, further comprising correcting the additional drying time according to a drying course based on a user's selection.

* * * * *

UNITED STATES PATENT AND TRADEMARK OFFICE

CERTIFICATE OF CORRECTION

PATENT NO. : 7,975,338 B2
APPLICATION NO. : 12/465157
DATED : July 12, 2011
INVENTOR(S) : Seung Myun Baek et al.

It is certified that error appears in the above-identified patent and that said Letters Patent is hereby corrected as shown below:

Title Page, Item (30) insert after (22)

--(30) Foreign Application Priority Data

| | | |
|---|---|---|
| May 23, 2003 | (KR) | 10-2003-0032961 |
| May 23, 2003 | (KR) | 10-2003-0032963-- |

Signed and Sealed this
Sixth Day of December, 2011

David J. Kappos

David J. Kappos
*Director of the United States Patent and Trademark Office*